US009297184B2

(12) United States Patent
Lazovski

(10) Patent No.: US 9,297,184 B2
(45) Date of Patent: Mar. 29, 2016

(54) KEY WITH INDICATION "LOCKED—UNLOCKED" OF A CYLINDER LOCK

(71) Applicant: Tase Lazovski, Nova Gorcia (SI)

(72) Inventor: Tase Lazovski, Nova Gorcia (SI)

( * ) Notice: Subject to any disclaimer, the term of this patent is extended or adjusted under 35 U.S.C. 154(b) by 0 days.

(21) Appl. No.: 14/397,593

(22) PCT Filed: May 30, 2013

(86) PCT No.: PCT/SI2013/000034
§ 371 (c)(1),
(2) Date: Oct. 28, 2014

(87) PCT Pub. No.: WO2013/180667
PCT Pub. Date: Dec. 5, 2013

(65) Prior Publication Data

US 2015/0300042 A1 Oct. 22, 2015

(30) Foreign Application Priority Data

May 30, 2012 (SI) ..... P-201200172

(51) Int. Cl.
*E05B 19/22* (2006.01)

(52) U.S. Cl.
CPC ..... *E05B 19/22* (2013.01)

(58) Field of Classification Search
CPC . E05B 19/22; Y10T 70/8027; Y10T 70/8189; Y10T 70/7876; Y10T 70/8676
USPC ..... 70/408, 460, 432, 438, 441
See application file for complete search history.

(56) References Cited

U.S. PATENT DOCUMENTS 1,998,799 A * 4/1935 Woina ..... A45C 11/324 70/456 R
2,198,484 A * 4/1940 Merkl ..... E05B 19/22 70/395
2,418,046 A * 3/1947 Oberfield ..... E05B 19/22 70/395
2,561,944 A * 7/1951 Oberfield ..... E05B 19/22 70/395
3,406,546 A * 10/1968 Clement ..... A45C 11/324 206/37.3
3,599,458 A * 8/1971 Chow ..... A45C 11/324 70/459
3,696,649 A * 10/1972 Chow ..... A45C 11/324 70/456 R
3,797,291 A * 3/1974 Simorghi ..... A45C 11/32 70/395
4,440,011 A * 4/1984 Klein ..... E05B 19/22 116/200
4,660,397 A * 4/1987 Girimont ..... A45C 11/321 70/456 B
5,117,666 A * 6/1992 Keefer ..... A45C 11/321 70/456 R
5,435,160 A * 7/1995 Linsalato ..... E05B 19/22 40/330

(Continued)

FOREIGN PATENT DOCUMENTS

CH 188571 A 1/1937
CH 437038 A 5/1967

(Continued)

OTHER PUBLICATIONS

International Search Report; PCT/SI2013/000034; Nov. 26, 2013.

*Primary Examiner* — Suzanne Barrett
(74) *Attorney, Agent, or Firm* — Studebaker & Brackett PC

(57) ABSTRACT

A key with indication "locked-unlocked" of a cylinder lock and comprising in its gripping section a manually movable slider for indicating "locked-unlocked" is designed in a way that in a gripping section there is arranged a recess comprising in its central section a pair of projections, wherein the slider arranged in the recess consists of two halves containing a mutually complementary middle tubular part and an external wide part extending at least partially over the contour of the recess.

5 Claims, 2 Drawing Sheets

(56) References Cited

U.S. PATENT DOCUMENTS 6,575,005 B1 * 6/2003 Hunter ..... E05B 19/22 70/395
6,651,470 B1 * 11/2003 Rafter ..... E05B 19/04 70/395
7,370,501 B2 * 5/2008 Miyata ..... E05B 19/043 70/395
2004/0080403 A1 * 4/2004 Eshel ..... G07C 9/00944 340/425.5

FOREIGN PATENT DOCUMENTS

JP 49-099687 A 8/1974
WO 2011/051991 A1 5/2011

* cited by examiner

KEY WITH INDICATION "LOCKED—UNLOCKED" OF A CYLINDER LOCK

OBJECT OF THE INVENTION

The object of the present invention is a key with indication "locked-unlocked" of a cylinder lock.

TECHNICAL PROBLEM

The technical problem solved by the present invention is a design of an accessory on a key of a cylinder lock, with which a user can indicate a respective locked or unlocked mode of a cylinder lock at any time, wherein said indicating accessory should be adapted for an automatic installation into a key.

PRIOR ART

Quite a few inventions deal with a need of users to indicate a mode "locked-unlocked" of a cylinder lock with the purpose of avoiding possible forgetfulness.

PCT-patent application WO 2011/051991 A1 (Azzal Franco) discloses an accessory of this type. It consists of a slider on a gripping section of a key and indicates in its end positions a mode "locked-unlocked" in a way that the slider is alternately moved to one of the symbols "locked-unlocked" arranged on the gripping section of the key. A drawback of this construction is a huge number of constituent parts, which increases the price of the product above expectations on the market.

A study of this problem brings us to a need for such a design of said product that will offer a possibility of upgrading an existing product by street key makers for a reasonable price.

SOLUTION TO THE TECHNICAL PROBLEM

The set technical problem is solved by a key of the invention which is new in being provided with an oblong recess in its gripping section, said recess having a slider and the recess being designed as a guide of the slider; or a guide with a movable slider can be arranged in the recess. This construction meets a need for a reasonably priced product both for primary and subsequent installation. As plastics is intended to be used for production, it is obvious that each individual key can have colour coding in order for a quicker identification of a key in a bunch of keys.

Figure 1:
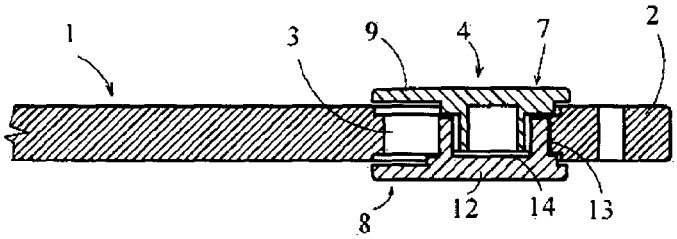
Figure 2:
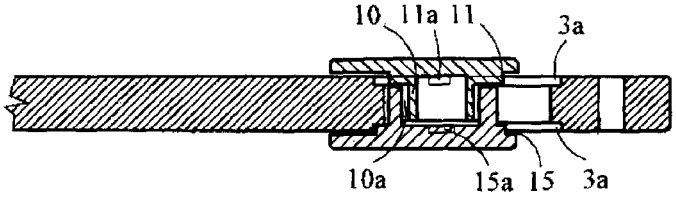
Figure 3:
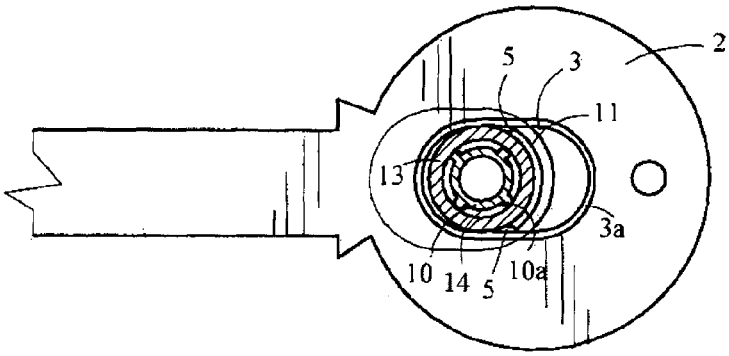
Figure 4:
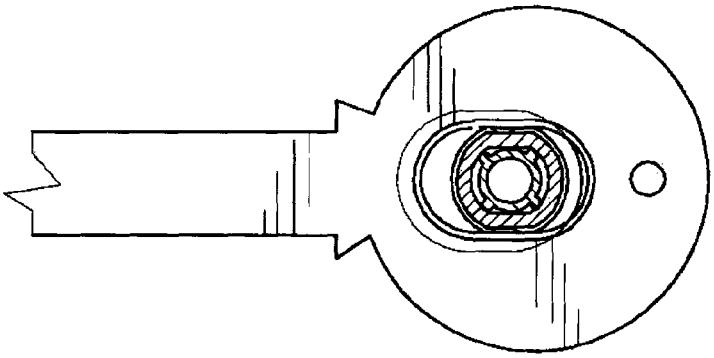
Figure 5:
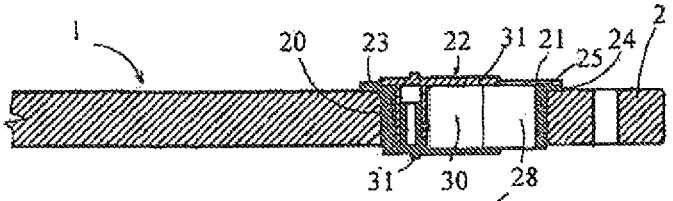
Figure 6:
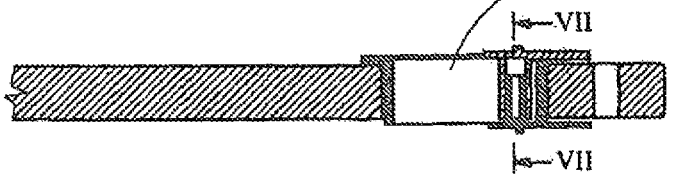
Figure 7:
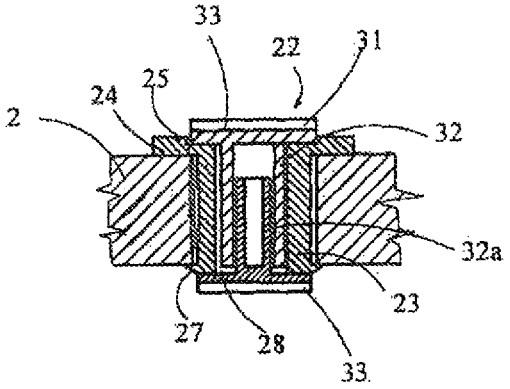
Figure 8:
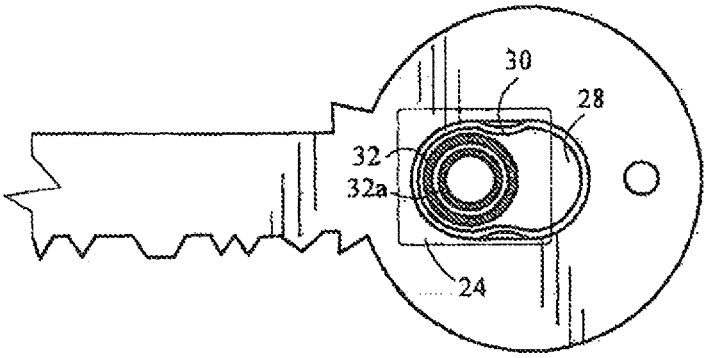

The invention will be explained in more detail in the continuation of the description by way of three embodiments and the enclosed drawings showing in FIG. 1 a longitudinal cross-section of a key of a cylinder lock with a slider according to the first embodiment; in "locked" mode;

FIG. 2 a longitudinal cross-section of a key of a cylinder lock with a slider according to the first embodiment; in "unlocked" mode;

FIG. 3 elevation of a key of a cylinder lock with a slider according to the first embodiment; in "unlocked" position;

FIG. 4 elevation of a key of a cylinder lock with a slider according to the first embodiment; in a transitional (intermediate) position of the slider;

FIG. 5 a longitudinal cross-section of a key of a cylinder lock with a slider according to the second embodiment; in "unlocked" mode;

FIG. 6 a longitudinal cross-section of a key of a cylinder lock with a slider according to the second embodiment; in "locked" mode;

FIG. 7 cross-section of a key of a cylinder lock with a slider according to the second embodiment, along line VII-VII of FIG. 6 and enlarged scale;

FIG. 8 elevation of a key of a cylinder lock with a slider according to the second embodiment; in "unlocked" position.

FIRST EMBODIMENT

A key 1 with indication "locked-unlocked" of a cylinder lock (not shown in figures) comprises a gripping section 2 with a recess 3 having an oblong contour of two partially overlapping circles, wherein the recess has two parallel step-like edges 3*a* acting as a guide of a slider 4 that is movably arranged in the recess 3. In the middle part of edges 3*a* there is a pair of projections 5 forming a narrowed section of the recess 3.

The slider 4 arranged in the recess 3 consists of two halves 7, 8. One half 7 consists of an external, preferably oval panel 9 that leans against one of the surfaces of the gripping section 2 and to which a middle cylindrical part 10 with a step-like ring 11 is integrally formed in an eccentric way at a panel 9, wherein the ring 11 is provided at diametrical parts with straight sections 11*a* acting as a guide of the slider 4 in the recess 3 and simultaneously prevent the slider 4 from rotating in the recess 3. On the lateral area of the cylindrical part 10 there are arranged ribs 10*a* extending parallel to its axis and being arranged remotely from edges 3*a* of the recess 3. The second half 8 of the slider 4 is also formed of an external, preferably oval panel 12 arranged at the opposite end of the gripping section 2 and to which a large tubular part 13 is formed integrally in an eccentric way. A cavity 14 of the tubular part 13 tightly fits in its middle part the cylindrical part 10 of the first half 7 in a way that the parts 13, 10 are complementary to each other. At its transition to the panel 12, the tubular part 13 includes a step-like ring 15 formed on diametric sections with straight sections 15*a* acting as a guide of the slider 4 in the recess 3 and simultaneously prevent the slider 4 from rotating in the recess 3, the same as the ring 11. The projections 5 in the recess 3 act as barriers when the slider 4 is moved and the latter is movable from one to another end position only through plastic deformation of the tubular part 13 when passing past the projections 5.

The gripping section 2 of the key 1 can be provided in the proximity of both ends of the recess 3 with symbols indicating the "locked-unlocked" mode of the lock. The symbols are optional and are not shown in figures. Instead of symbols the recess 3 can be used as the indicator, which is partially visible in the "unlocked" mode and completely covered with panels 9 and 12 of the slider 4 in the "locked" mode.

The slider 4 arranged in the recess 3 is pushed with fingers to one or another end position, with which the "locked-unlocked" mode of the lock is indicated. The projections 5 in the recess 3 prevent the intermediate position of the slider 4 and consequently undefined indication of the lock mode.

The slider can be moved in any direction, preferably the longitudinal direction of the key or the direction rectangular thereto are reasonable.

SECOND EMBODIMENT

The second embodiment is suited especially for subsequent installation. It is foreseen that a drilled hole for arranging an assembly of elements for indication "unlocked-locked" is made with conventional locksmith's tools.

In the gripping section 2 of the key 1 of the second embodiment there is a round or oblong recess 20. An insert 21 containing a slider 22 is fixed in the recess 20.

The insert 21 consists of an oblong ring-shaped part 23 that fits the recess 20. One edge of the ring-shaped part 23 is provided with a flange 24 of a rectangular or oval shape and with a flat groove 25 as a guide for the slider 22 described later herein. The opposite edge of the ring-shaped part 23 includes snap teeth 27 for a positive-fit connection with the gripping section 2 of the key 1. The ring-shaped part 23 has an aperture 28, into which a two-part slider 22 is arranged in a sliding manner. The aperture 28 is oblong and at least one longer side wall 30 is elastic and vaulted into the aperture 28.

The slider 22 consists of two parts 31. Each part 31 of the slider 22 is made of a middle part 32, 32*a* arranged in the aperture 28. The middle parts 32, 32*a* are integrally formed with external gripping sections 33 adapted for a manual movement of the slider 22 in the aperture 28. The middle parts 32 and 32*a* of both parts 31 are formed for a mutual positive-fit connection. This connection is preferably made in a way that the middle part 32 of one part 31 is hollow to unreleasably receive the middle part 32*a* of the second part 31. The external gripping part 33 of one part 31 is guided in a flat groove 25 of the insert 21 and secured against rotation in the aperture 28.

The slider 22 as described above is movable from one to another end position in the insert 21 manually thus indicating the mode of the lock: locked-unlocked.

THIRD EMBODIMENT

The third embodiment, which is not shown in figures, is a combination of a slider with the properties of the first and second embodiments. The insert 21 from the second embodiment has a recess equaling the recess 3, and the slider 4 of the first embodiment.

The invention claimed is:

1. A key with an indication "locked-unlocked" of a cylinder lock, said key comprising a gripping section having a manually movable slider for indicating "locked-unlocked", the gripping section having a recess with an oblong contour of two partially overlapping circles, a pair of projections provided in a middle part of the recess, said pair of projections forming a narrowed section of the recess, the slider being arranged in the recess and including two halves containing a mutually complementary middle tubular part and an external wide part extending at least partially over a contour of the recess.

2. A key with an indication "locked-unlocked" of a cylinder lock, said key comprising a gripping section having a manually movable slider for indicating "locked-unlocked", the gripping section having a round or oblong recess, in which an insert including a two-part slider is fixed, the insert including an oblong ring-shaped part fitting the recess and an edge of which is provided with a flange of a rectangular or oval shape and with a flat groove, an opposite edge including snap teeth for a positive-fit connection with the gripping section, and the ring-shaped part having an aperture, in which the two-part slider is arranged in a sliding manner, wherein the aperture is oblong and at least one of longer side walls is elastic and vaulted into the aperture.

3. The key according to claim 2, wherein each part of the two-part slider is made of a middle part arranged in the aperture and made for a mutual positive-fit connection, and on which external gripping parts are integrally formed.

4. The key according to claim 3, wherein the middle part of one part of the two-part slider is hollow to receive the middle part of the other part of the two-part slider in an unreleasable manner.

5. Key according to claim 3, wherein the external gripping part of one part of the two-part slider is guided in the flat groove of the insert.

* * * * *

UNITED STATES PATENT AND TRADEMARK OFFICE

CERTIFICATE OF CORRECTION

PATENT NO. : 9,297,184 B2
APPLICATION NO. : 14/397593
DATED : March 29, 2016
INVENTOR(S) : Tase Lazovski It is certified that error appears in the above-identified patent and that said Letters Patent is hereby corrected as shown below:

On the Title Page
Item (71) change "Nova Gorcia" to --Nova Gorica--.
Item (72) change "Nova Gorcia" to --Nova Gorica--.

Signed and Sealed this
Seventh Day of June, 2016

Michelle K. Lee

Michelle K. Lee
*Director of the United States Patent and Trademark Office*